US010498034B2

(12) United States Patent
Liu et al.

(10) Patent No.: US 10,498,034 B2
(45) Date of Patent: Dec. 3, 2019

(54) ANTENNA MODULE

(71) Applicant: ACCTON TECHNOLOGY CORPORATION, Hsinchu (TW)

(72) Inventors: I-Ru Liu, Hsinchu (TW); Yen-Lin Liao, Hsinchu (TW); Hsin-Hsiung Kang, Hsinchu (TW); Li-Hua Chou, Hsinchu (TW); Wen-Pin Lo, Hsinchu (TW); Chun-Yi Kuo, Hsinchu (TW); Chang-Cheng Liu, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 169 days.

(21) Appl. No.: 15/631,466

(22) Filed: Jun. 23, 2017

(65) Prior Publication Data

US 2018/0301810 A1 Oct. 18, 2018

(30) Foreign Application Priority Data

Apr. 13, 2017 (CN) ..... 2017 2 0383742 U

(51) Int. Cl.
*H01Q 5/385* (2015.01)
*H01Q 19/00* (2006.01)

(52) U.S. Cl.
CPC ..... *H01Q 5/385* (2015.01); *H01Q 19/00* (2013.01)

(58) Field of Classification Search
CPC ..... H01Q 3/446; H01Q 5/40; H01Q 5/49; H01Q 9/32; H01Q 19/32; H01Q 1/38; H01Q 21/067; H01Q 5/385
See application file for complete search history.

(56) References Cited

U.S. PATENT DOCUMENTS

2003/0193446 A1* 10/2003 Chen ..... H01Q 1/246 343/893
2010/0060513 A1* 3/2010 Henderson ..... H01Q 1/28 342/153
2010/0328177 A1* 12/2010 Kemp ..... H01Q 9/30 343/834
2014/0313080 A1* 10/2014 Smith ..... H01Q 3/00 342/372
2015/0194740 A1* 7/2015 Ju ..... H01Q 21/28 343/817

* cited by examiner

*Primary Examiner* — Jessica Han
*Assistant Examiner* — Awat M Salih
(74) *Attorney, Agent, or Firm* — Tracy M. Heims; Apex Juris, pllc.

(57) ABSTRACT

An antenna module is disclosed. The antenna module includes a circuit board and at least one antenna set. Wherein, the antenna set includes a driving antenna and a plurality of parasitic antennas. The driving antenna is formed on the circuit board, and the parasitic antennas are positioned with the driving antenna as a center on the circuit board. Whereby, the space occupied by the antenna module can be small, and beams of wireless signals radiated by the antenna module can be controlled.

11 Claims, 15 Drawing Sheets

ANTENNA MODULE

BACKGROUND OF THE INVENTION

1. Technical Field

The present invention is related to wireless signals, and more particularly to an antenna module.

2. Description of Related Art

With the improvement in wireless communication technology, more and more electronic devices transmit data via wireless signals. In wireless systems, a wireless signal transceiver is utilized to transmit and receive wireless signals, such as a wireless signal access point.

A conventional wireless signal transceiver includes a circuit board, a signal processing circuit, and an antenna. Wherein, the signal processing circuit is positioned on the circuit board, while the antenna is formed independently outside of the circuit board, and is connected to the circuit board via electrical pads or conductive wires. The drawback of the conventional design is that the antenna usually occupies an additional space. Besides, a single antenna cannot radiate wireless signal beams in an arbitrary direction. The communication devices nowadays are made more compact, and therefore a small size antenna with the capability of good radiation effect is on demand.

BRIEF SUMMARY OF THE INVENTION

In view of the above, the primary objective of the present invention is to provide an antenna module which could be made in a small size, and be controlled to radiate wireless signals in arbitrary directions.

The present invention provides an antenna module including a circuit board and at least one antenna set. Wherein, the antenna set includes a driving antenna and a plurality of parasitic antennas. The driving antenna is positioned on the circuit board, and the corresponding parasitic antennas are positioned with the driving antenna as a center on the circuit board.

By arranging the positions of the driving antenna and the parasitic antennas on the circuit board, the occupied space could be small, and the resultant antenna module could be controlled to radiate wireless signal beam in arbitrary directions as required.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
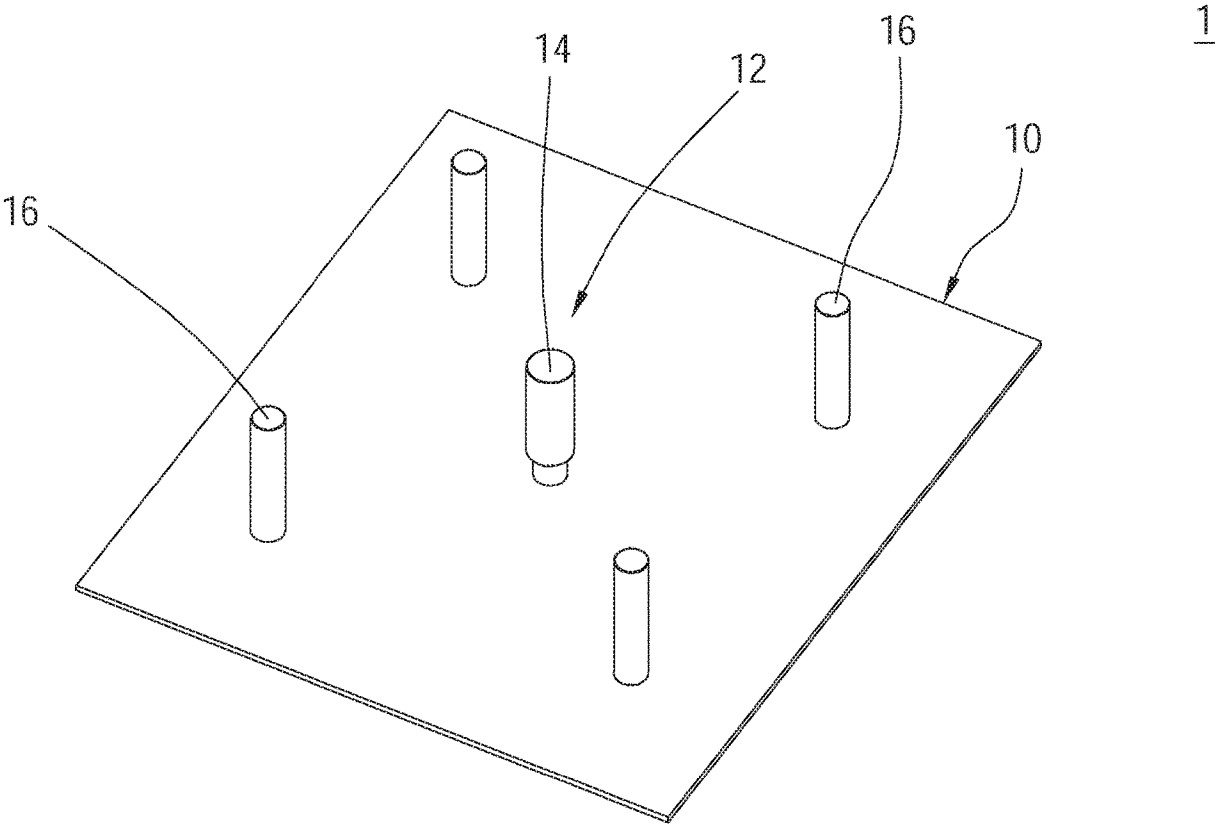
FIG. 1 is a perspective view of an antenna module in accordance with a first embodiment of the present invention.

The following illustrative embodiments and drawings are provided to illustrate the disclosure of the present invention, these and other advantages and effects can be clearly understood by persons skilled in the art after reading the disclosure of this specification. As shown in FIG. 1 to FIG. 5, an antenna module 1 which includes a circuit board 10 and an antenna set 12 according to a first embodiment of the present invention is illustrated. Wherein:

The circuit board 10 is a printed circuit board and includes a plurality of soldering holes 102, a control circuit (not shown) adapted to control the antenna set 12, and a signal processing circuit (not shown) adapted to convert electric signals into wireless signals.

The antenna set 12 includes a driving antenna 14 and a plurality of parasitic antennas 16. In this embodiment, the driving antenna 14 is controlled by the control circuit and radiates wireless signals at frequencies of a 2.4 GHz frequency band, while each of the parasitic antennas 16 is respectively controlled by the control circuit to guide or reflect the wireless signals radiated by the driving antenna 14 to a specific direction so as to make the antenna set 12 as a beam-controllable antenna.

Figure 4:
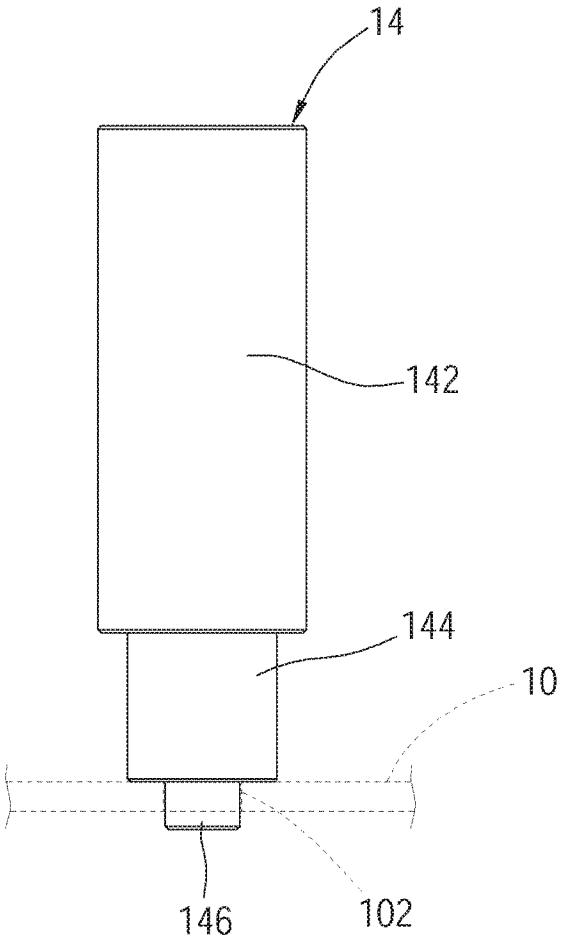
FIG. 4 is a side view of the driving antenna in accordance with the above embodiment of the present invention.

As shown in FIG. 4, the driving antenna 14 is cylindrical, and includes a first section 142, a second section 144, and a third section 146 which are connected in sequence. Wherein, the first section 142 constitutes a top load of the driving antenna 14. A diameter of the first section 142 is greater than that of the second section 144, and a length of the first section 142 is longer than that of the second section 144. The second section 144 is positioned between the first section 142 and the circuit board 10. A diameter of the third section 146 is smaller than that of the second section 144, and the third section 146 constitutes a solder pin of the driving antenna 14. The third section 146 is soldered to the soldering hole 102 of the circuit board 10 via solder paste so as to position the driving antenna 14 be the circuit board 10. In this embodiment, the diameter and the length of the first section 142 are respectively 7 mm and 17 mm, the diameter and the length of the second section 144 are respectively 5 mm and 5 mm, and the diameter and the length of the third section 146 are respectively 2.5 mm and 1.6 mm. In practice, since the third section 146 is used for soldering purpose only, the third section 146 can be omitted. The driving antenna 14 can be directly soldered to the circuit board via the second section 144 instead.

Figure 5:
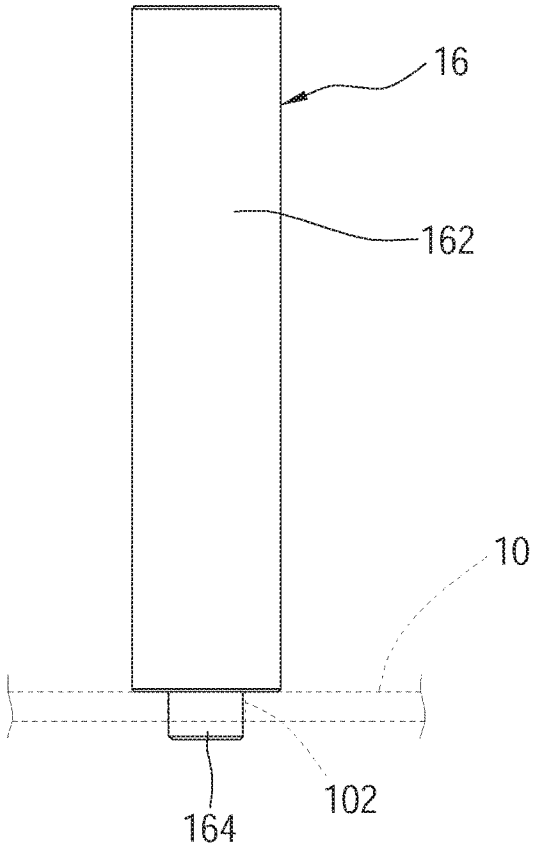
FIG. 5 is a side view of one of the parasitic antennas in accordance with the above embodiment of the present invention.

In this embodiment, the plurality of parasitic antennas includes four parasitic antennas 16, but it is not limited thereto. The parasitic antennas 16 are distributed around the driving antenna 14 and positioned on the circuit board 10 with the driving antenna 14 as a center. As shown in FIG. 5, each of the parasitic antennas 16 is cylindrical, and includes a first section 162 and a second section 164 connected in sequence. A diameter of the first section 162 is greater than that of the second section 164, and a length of the first section 162 is longer than that of the second section 164. The second section 164 constitutes a soldering pin of the parasitic antenna 16, and is soldered to the soldering hole 102 of the circuit board 10 via soldering paste so as to position the parasitic antennas 16 on the circuit board. In this embodiment, for the parasitic antenna 16, the diameter and the length of the first section 162 thereof are respectively 5 mm and 23 mm, and the diameter and the length of the second section 164 thereof are respectively 2.5 mm and 1.6 mm. For the parasitic antennas 16, a distance between each central axis thereof and the central axis of the driving antenna 14 are the same. The distance L1 between each central axis of the parasitic antennas 16 and the central axis of the driving antenna 14 is between 37.4 mm and 47.4 mm. In this embodiment, the distance L1 is 42.4 mm. The distance L2 between every two central axes of adjacent parasitic antennas 16 is between 55 and 66 mm. In this embodiment, the distance L2 is 60 mm.

Figure 2:
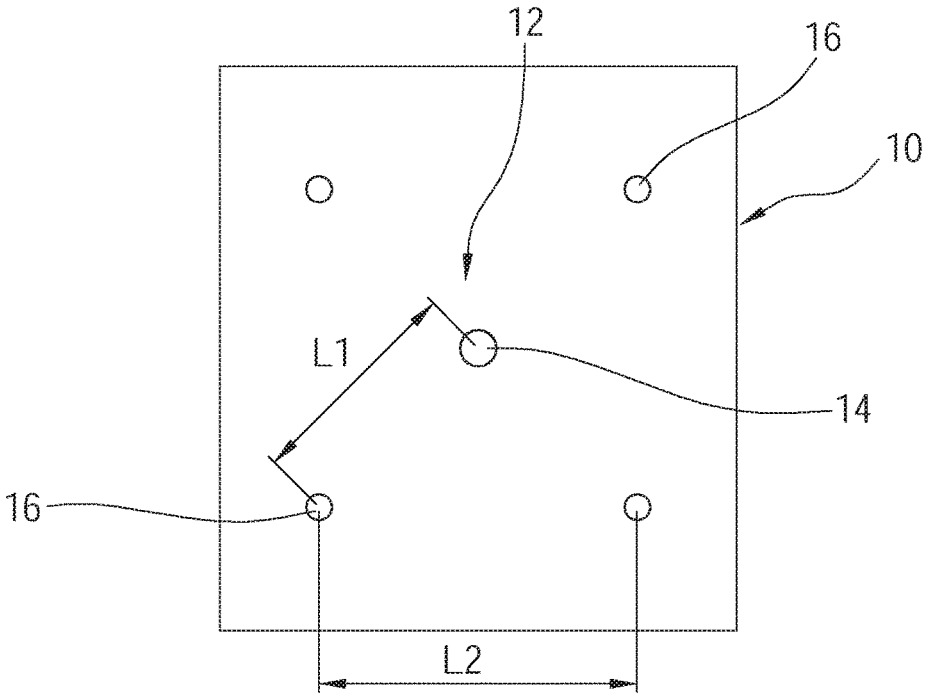
FIG. 2 is a top view of the antenna module in accordance with the above embodiment of the present invention.
Figure 3:
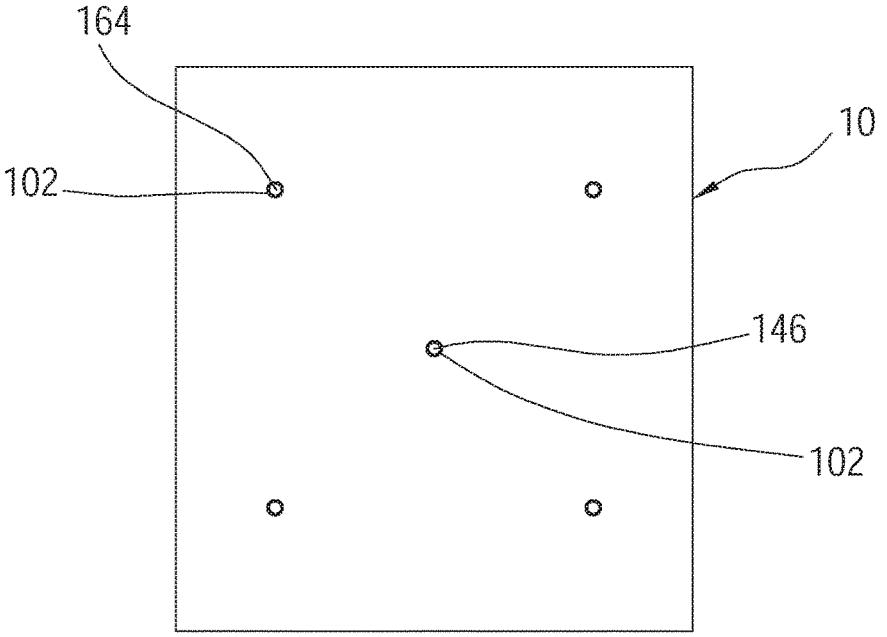
FIG. 3 is a bottom view of the antenna module in accordance with the above embodiment of the present invention.
Figure 6:
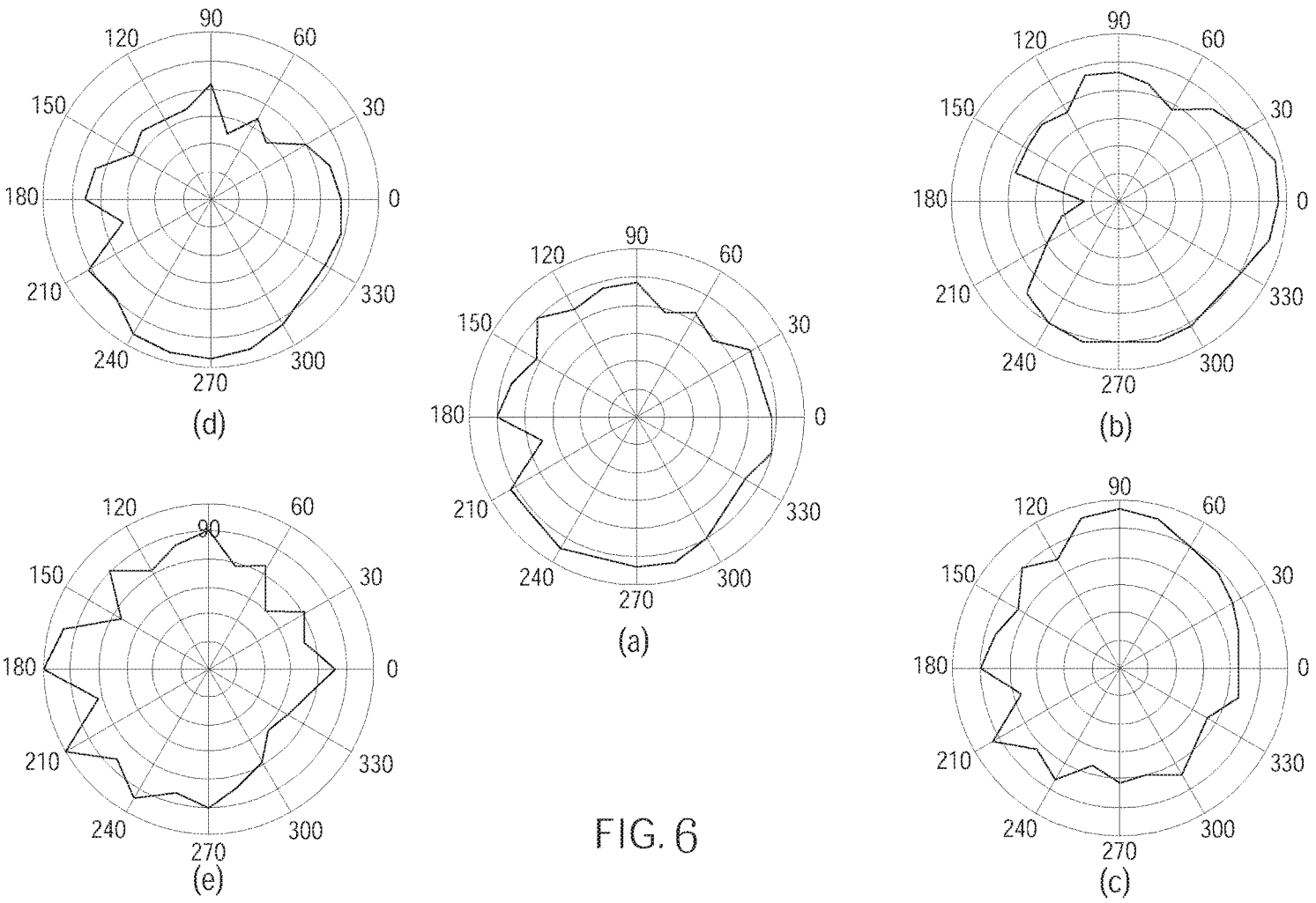
FIG. 6 is a radiation pattern of the antenna module operating at 2.4 GHz frequency band in accordance with the above embodiment of the present invention.
Figure 7:
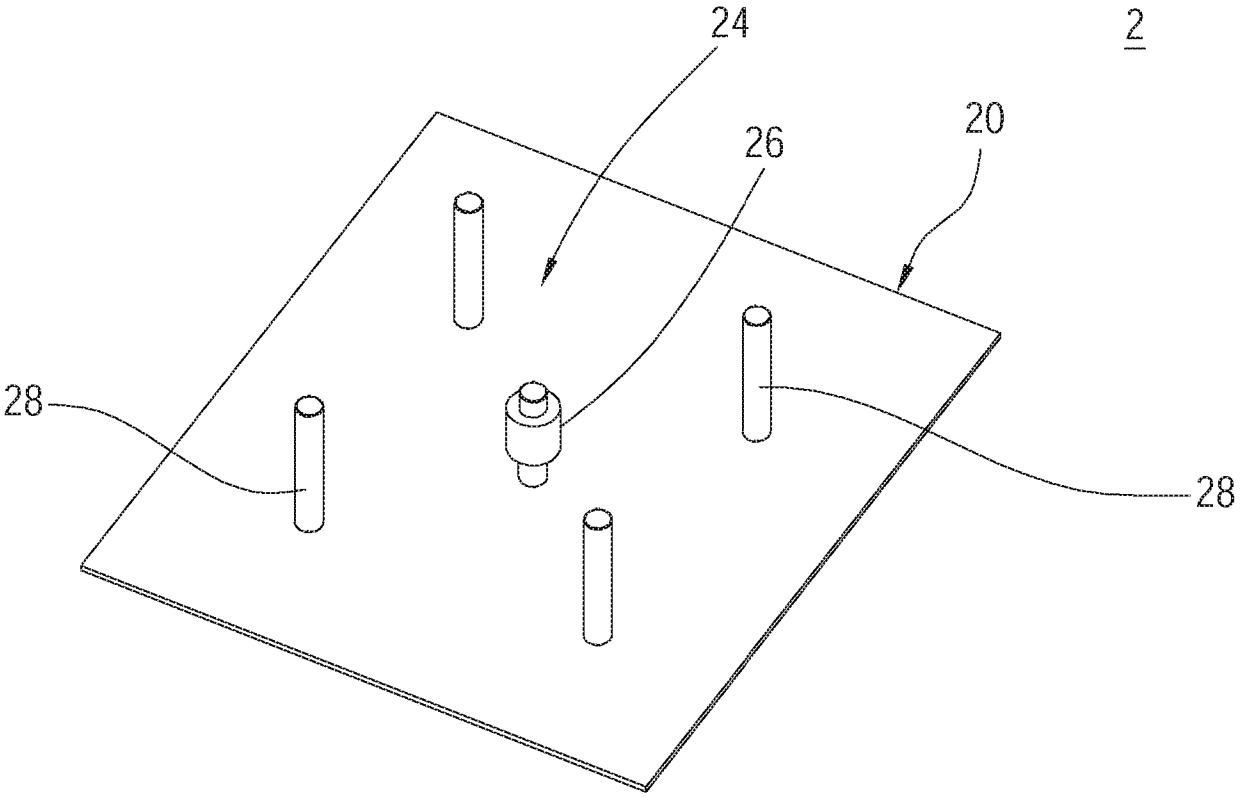
FIG. 7 is a perspective view of an antenna module in accordance with a second embodiment of the present invention.

As shown in FIG. 2 and FIG. 6, wherein, FIG. 6(*a*) is a radiation pattern of the antenna set 12 which the wireless signal beams are controlled to be omnidirectional radiated; FIG. 6(*b*) is a radiation pattern of the antenna set 12 which the wireless signal beams are controlled to be rightward radiated with respect to FIG. 2; FIG. 6(*c*) is a radiation pattern of the antenna set 12 which the wireless signal beams are controlled to be upward radiated with respect to FIG. 2; FIG. 6(*d*) is a radiation pattern of the antenna set 12 which the wireless signal beams are controlled to be downward radiated with respect to FIG. 2; and FIG. 6(*e*) is a radiation pattern of the antenna set 12 which the wireless signal beams are controlled to be leftward radiated with respect to FIG. 2.

From the above, it can be understood that the antenna module 1 of this embodiment could be formed with a small size and be beam-controllable by positioning the driving antenna 14 and the parasitic antenna 16 so as to fulfill the need of controlling wireless signal beams to be radiated intensively in a specific direction.

FIG. 7 to FIG. 11 are drawings of an antenna module 2 in accordance with a second embodiment of the present invention which includes a structure substantially the same with that of the first embodiment, and includes a circuit board 20 and an antenna set 24. The difference is:

In this embodiment, the driving antenna 26 can radiate wireless signals at frequencies of a 5 GHz frequency band. In more detail, the driving antenna 26 includes a first section 262, a second section 264, a third section 266 and a fourth section 268 which are connected in sequence. Wherein, the second section 264 constitutes a medium load of the driving antenna 26 and the third section 266 is positioned between the second section 264 and the circuit board 20. A diameter of the second section 264 is greater than those of the first section 262 and the third section 266, while a length of the second section 264 is greater than that of the third section 266 and a length of the first section 262 is smaller than that of the second section 264. A diameter of the fourth section 268 is smaller than that of the third section 266, and the fourth section 268 constitutes a soldering pin of the driving antenna 26 and is soldered to a soldering hole 202 of the circuit board 20 via soldering paste. In this embodiment, the diameter and the length of the first section 262 are respectively 2.6 mm and 2 mm; the diameter and the length of the second section 264 are respectively 5 mm and 5 mm; the diameter and the length of the third section 266 are respectively 2.6 mm and 4 mm; and the diameter and the length of the fourth section 268 are respectively 2.5 mm and 1.6 mm. In practice, the fourth section 268 can be omitted, and the driving antenna 26 can be directly soldered to the circuit board 20 via the third section 266 instead.

The parasitic antenna 28 includes a first section 282 and a second section 284 which are connected in sequence. Wherein, a diameter of the first section 282 is greater than that of the second section 284, and the length of the first section 282 is longer than that of the second section 284. The second section 284 constitutes a soldering pin of the parasitic antenna 28 and is soldered to a soldering hole 202 of the circuit board 20. In this embodiment, the diameter and the length of the first section 282 are respectively 2.6 mm and 15 mm, while the diameter and the length of the second section 284 are respectively 1 mm and 1.6 mm. The distance L1 between the central axis of the parasitic antenna 28 and the central axis of the driving antenna 26 is between 16.2 mm and 26.2 mm. In this embodiment, the distance L1 is 21.2 mm. The distance L2 between the central axes of two adjacent parasitic antennas 28 is between 25 mm and 35 mm. In this embodiment, the distance L2 is 30 mm.

Figure 8:
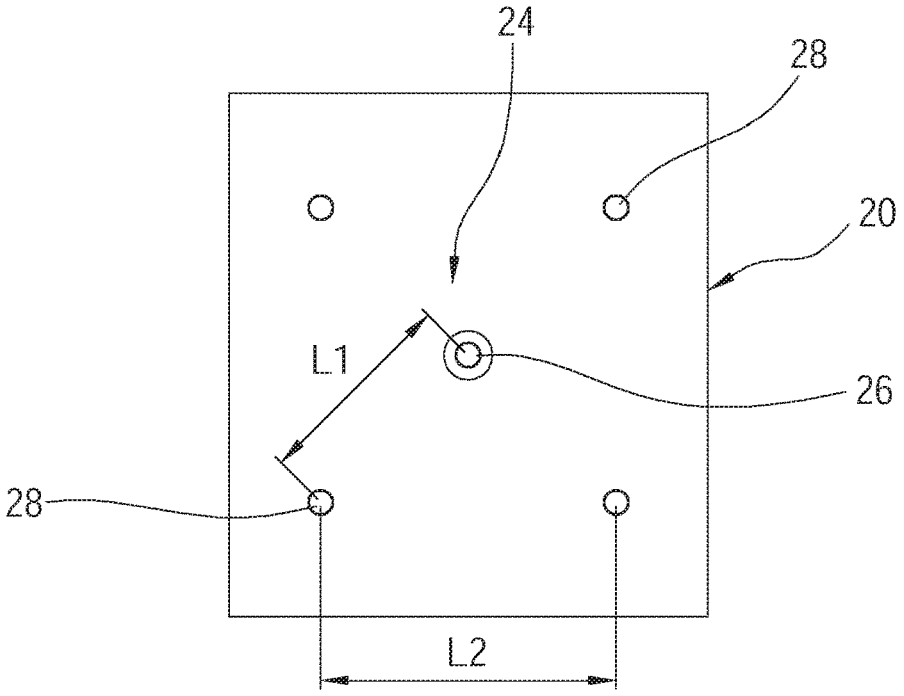
FIG. 8 is a top view of the antenna module in accordance with the above embodiment of the present invention.
Figure 9:
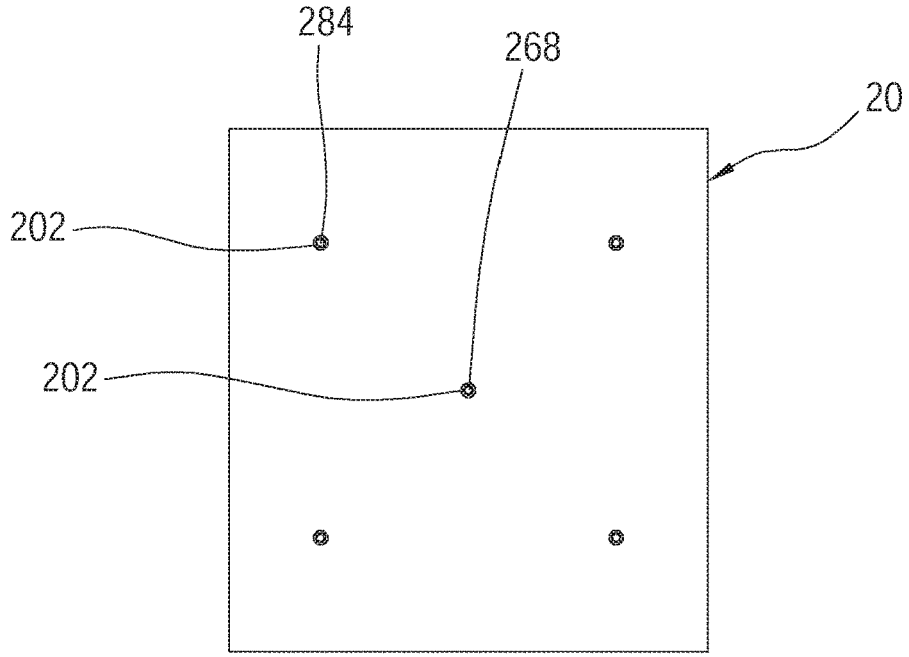
FIG. 9 is a bottom view of the antenna module in accordance with the above embodiment of the present invention.
Figure 10:
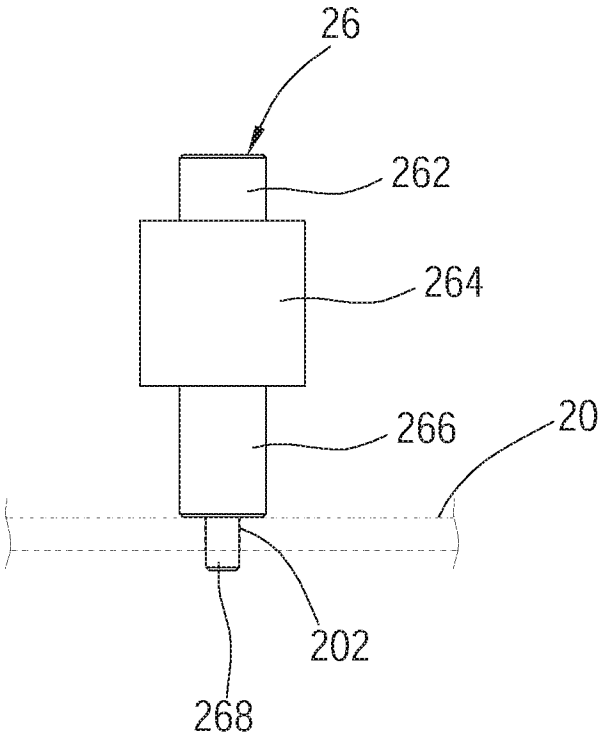
FIG. 10 is a side view of the driving antenna in accordance with the above embodiment of the present invention.
Figure 11:
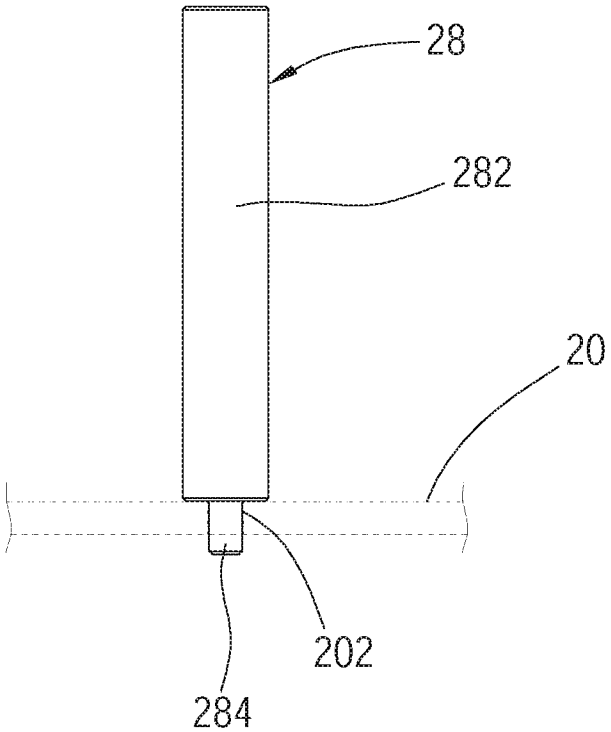
FIG. 11 is a side view of one of the parasitic antennas in accordance with the above embodiment of the present invention.
Figure 12:
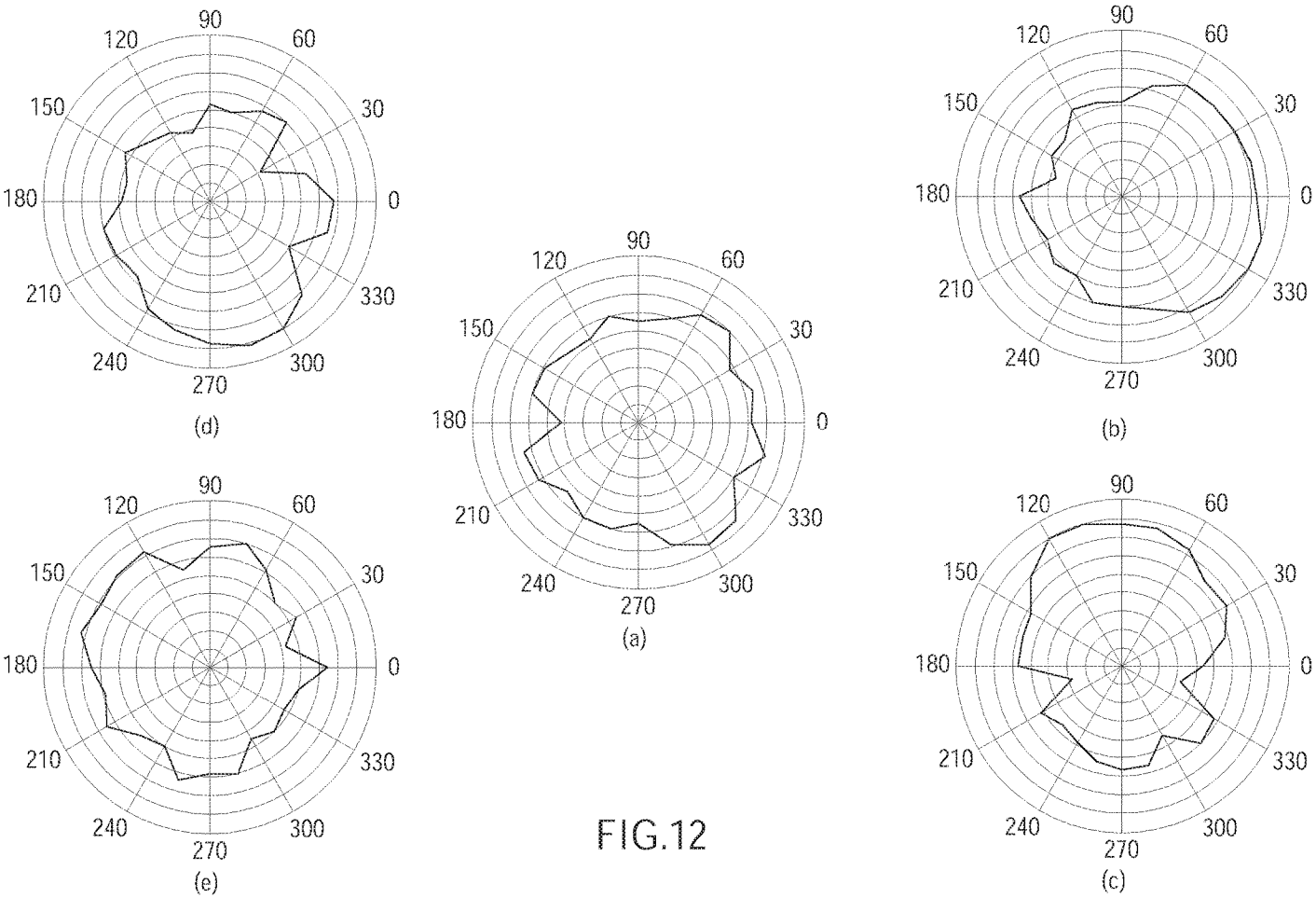
FIG. 12 is a radiation pattern of the antenna module operating at 5 GHz frequency band in accordance with the above embodiment of the present invention.

As shown in FIG. 8 and FIG. 12, wherein, FIG. 12(*a*) is a radiation pattern of the antenna set 24 which the wireless signal beams are controlled to be omnidirectional radiated; FIG. 12(*b*) is a radiation pattern of the antenna set 24 which the wireless signal beams are controlled to be rightward radiated with respect to FIG. 8; FIG. 12(*c*) is a radiation pattern of the antenna set 24 which the wireless signal beams are controlled to be upward radiated with respect to FIG. 8; FIG. 12(*d*) is a radiation pattern of the antenna set 24 which the wireless signal beams are controlled to be downward radiated with respect to FIG. 8; and FIG. 12(*e*) is a radiation pattern of the antenna set 24 which the wireless signal beams are controlled to be leftward radiated with respect to FIG. 8.

From the above, it can be understood that the antenna module 2 of this embodiment also could fulfill the demand of small size and the need of controlling wireless signal beams to be intensively radiated in a specific direction.

Figure 13:
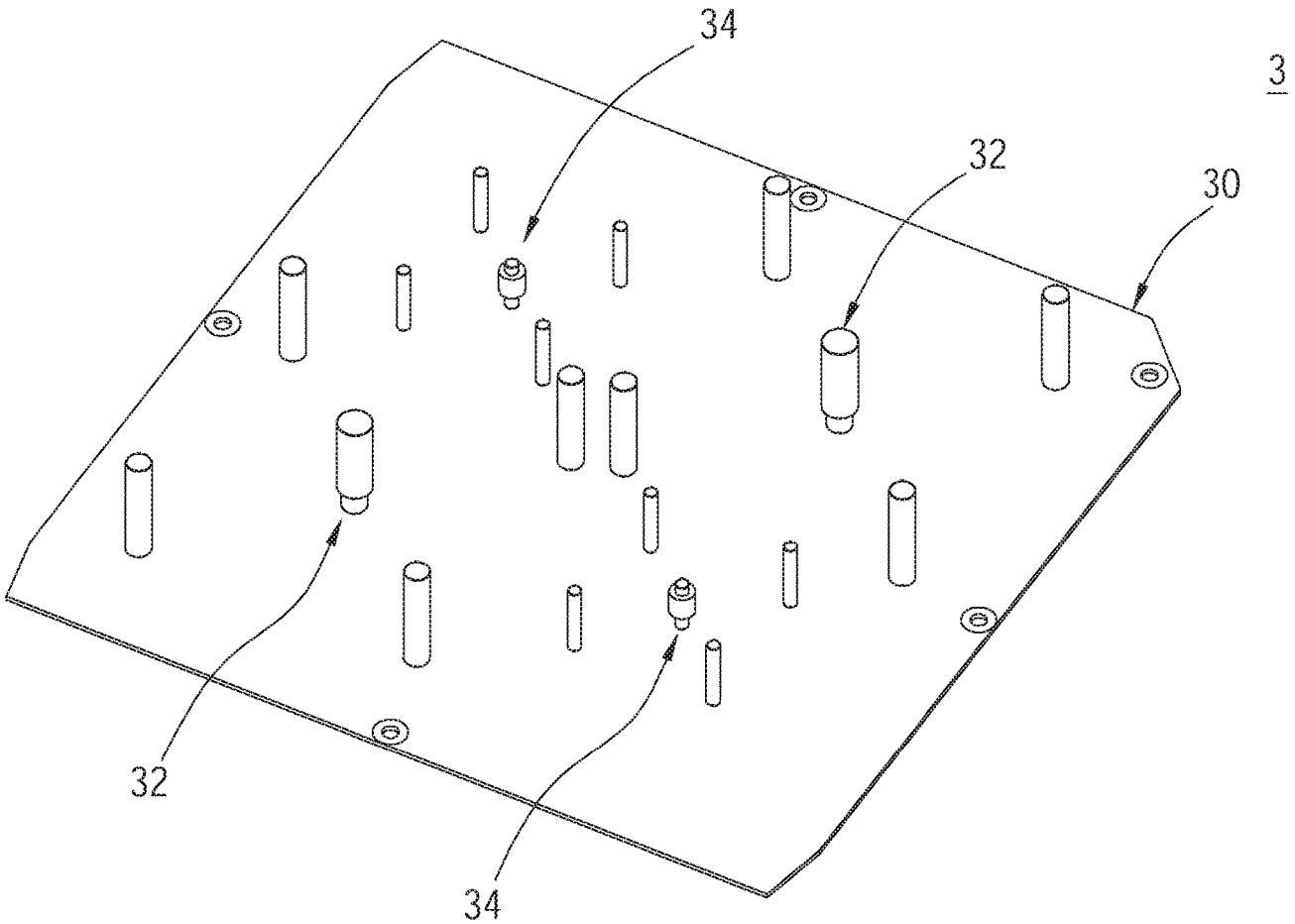
FIG. 13 is a perspective view of an antenna module in accordance with a third embodiment of the present invention.
Figure 14:
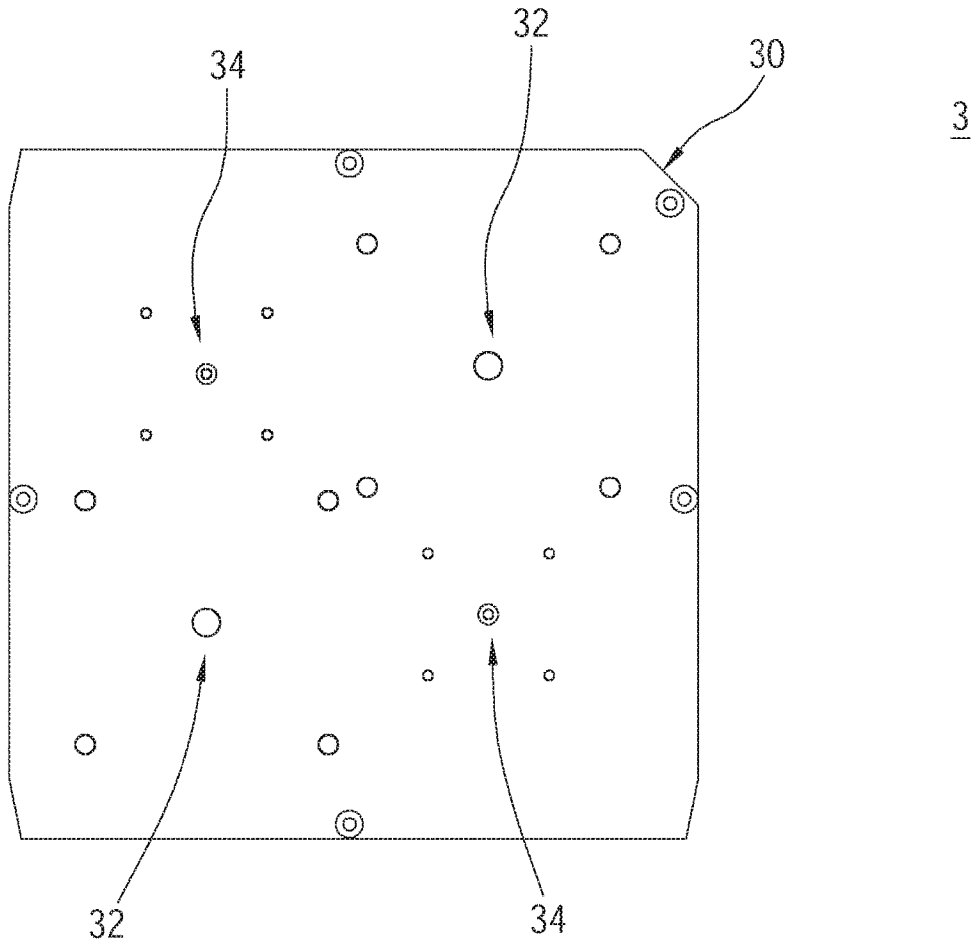
FIG. 14 is a top view of the antenna module in accordance with the above embodiment of the present invention.

As shown in FIG. 13 and FIG. 14, an antenna module 3 of a third embodiment according to the present invention is disclosed. The antenna module 3 is based on the concept of the first and the second embodiments and includes a circuit board 30 and a plurality of antenna sets including two first antenna sets 32 and two second antenna sets 34. Wherein, the structure of each of the first antenna sets 32 is the same as the structure of the antenna set 12 of the first embodiment, and the structure of each of the second antenna sets 34 is the same as the structure of the antenna set 24 of the second embodiment. Each of the first antenna sets 32 is corresponding to a first frequency band (2.4 GHz frequency band), while each of the second antenna sets 34 is corresponding to a second frequency band (5 GHz frequency band). The frequency ranges of the first frequency band and the second frequency band are different. The two first antenna sets 32 are positioned with interlaced arrangement, and the two second antenna sets 34 are positioned with interlaced arrangement. Each of the first antenna sets 32 is disposed adjacent to the two second antenna sets 34. Thus, the antenna module 3 of this embodiment constitutes a 2×2 Multiple Input Multiple Output (MIMO) antenna module. However, the number or constitution of the antenna sets is not limited thereto.

Figure 15:
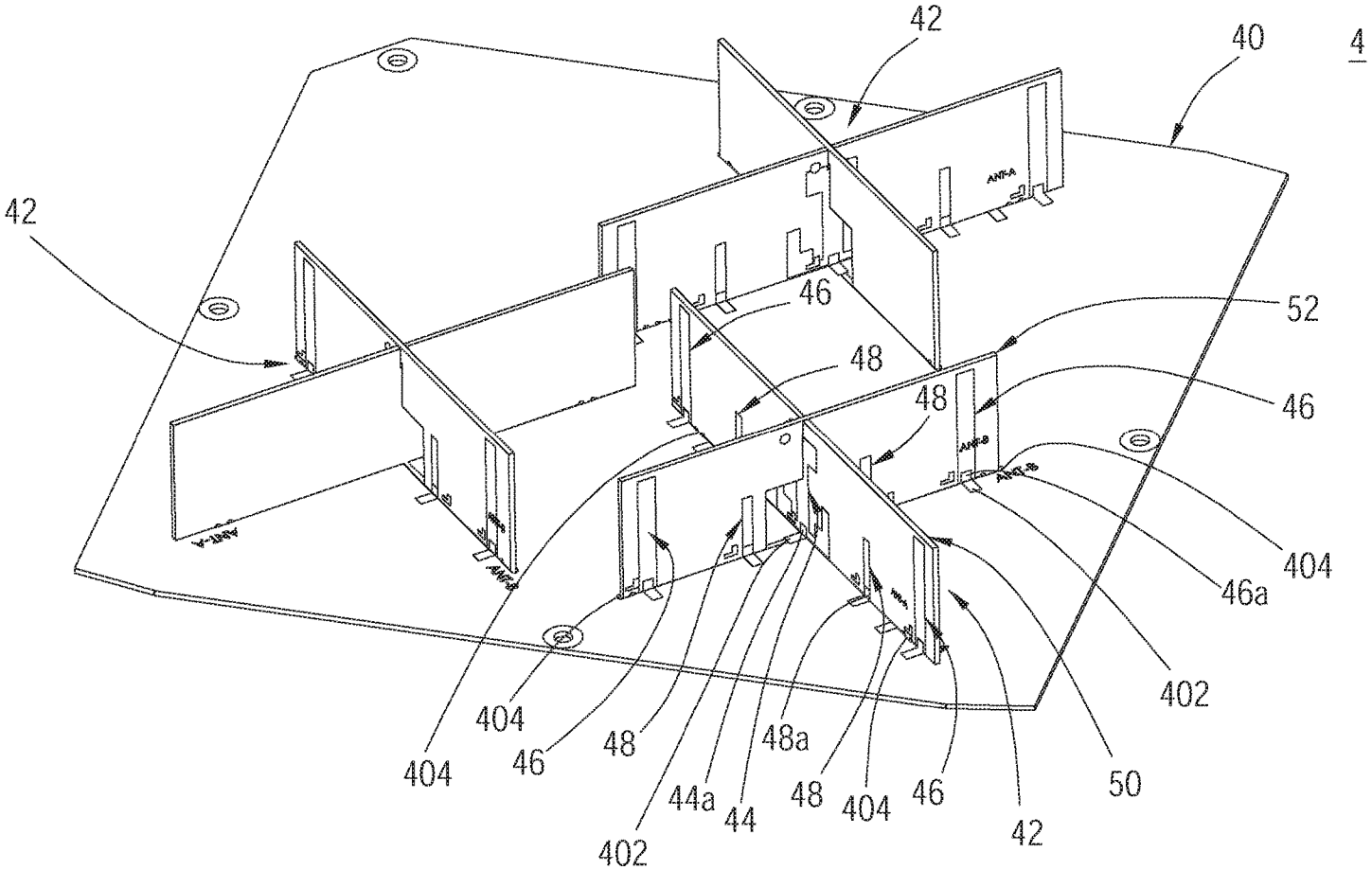
FIG. 15 is a perspective view of an antenna module in accordance with a fourth embodiment of the present invention.
Figure 16:
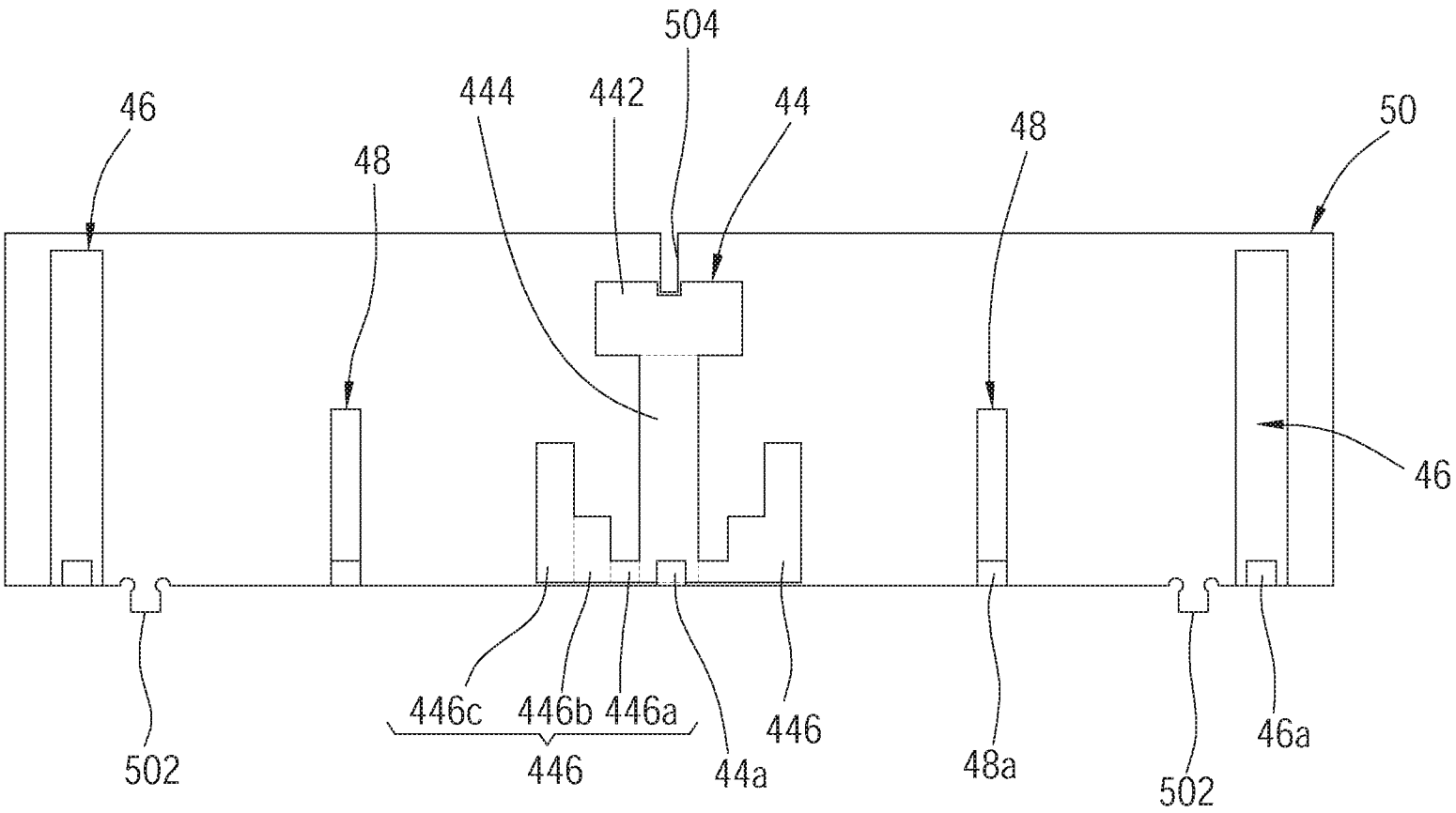
FIG. 16 is a front view of the first supporting plate in accordance with the above embodiment of the present invention.
Figure 17:
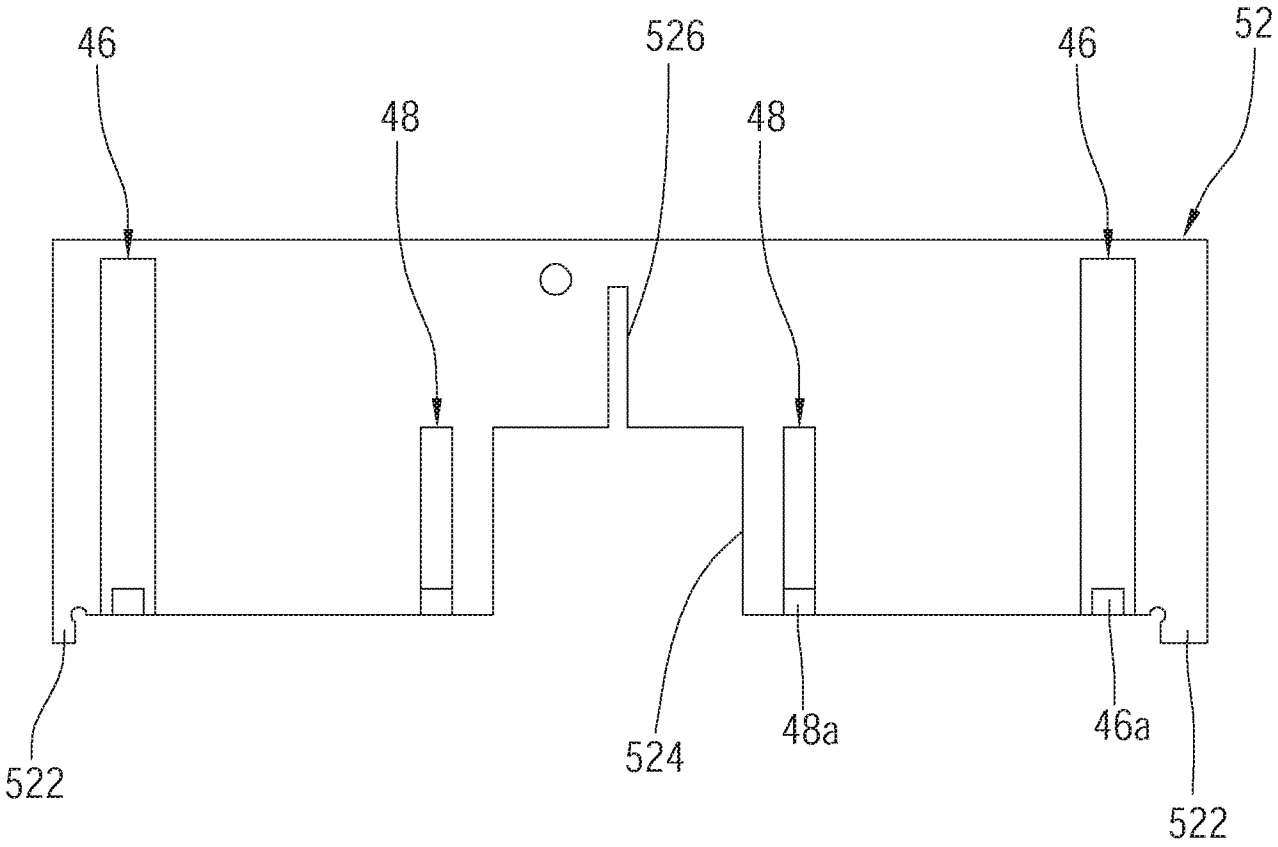
FIG. 17 is a front view of the second supporting plate in accordance with the above embodiment of the present invention.

FIG. 15 to FIG. 17 are illustration drawings of an antenna module 4 according to a fourth embodiment of the present invention. The antenna module 4 includes a circuit board 40 and at least one antenna set 42. In this embodiment, the antenna module 4 includes a plural of antenna sets 42. The circuit board 40 includes a plurality of soldering pads 402 and a plurality of sockets 404. Besides, the circuit board 40 includes a control circuit (not shown) for controlling each of the antenna sets and a signal processing circuit (not shown).

Each of the antenna sets 42 of this embodiment includes an identical structure. Taking the antenna set 42 shown in the bottom right corner of FIG. 15 for example, the antenna set 42 includes a driving antenna 44, a plurality of parasitic antenna, and a plurality of supporting plates. The parasitic antennas include four first parasitic antennas 46 and four second parasitic antennas 48. It is different from the aforementioned embodiments that the driving antenna 44, the first parasitic antennas 46 and the second parasitic antennas 48 are formed on the supporting plates with a plane layout method, while the supporting plates are inserted into the socket 404 of the circuit board. The supporting plate can be a printed circuit board, but it is not limited thereto.

More detail, as shown in FIG. 16 and FIG. 17, the supporting plates include a first supporting plate 50 and a second supporting plate 52. The bottom side of each of the first supporting plate 50 and the second supporting plate 52 includes a protrusion 502, 522, respectively, while the protrusions 502, 522 can be inserted into the sockets 404 of the circuit board 40. The top center portion of the first supporting plate 50 is grooved with a slot 504. The center portion of the second supporting plate 52 includes a rectangular recess 524 formed from bottom up, and the top surface of the recess 524 is up-grooved with another slot 526 in its center portion. By joining the slots 504, 526 of the first and the second supporting plates 50, 52, the first and the second supporting plates 50, 52 can be perpendicularly intersected with each other.

The first supporting plate 50 is formed with the driving antenna 44, two first parasitic antennas 46 and two second parasitic antennas 48. The driving antenna 44 is formed under the slot 504, the two first parasitic antenna 46 are respectively formed on the left and right sides of the driving antenna 44, and the two second parasitic antennas 48 are respectively formed on the left and right sides of the driving antenna 44 while each of the second parasitic antennas 48 is positioned between the driving antenna 44 and each of the first parasitic antennas 46.

The second supporting plate 52 is formed with two first parasitic antennas 46 and two parasitic antennas 48. Wherein, the two second parasitic antenna 48 are respectively positioned at the two sides of the recess 524, and the two first parasitic antenna 46 are respectively positioned outside of the second parasitic antenna 48, such that each of the second parasitic antenna 48 is positioned between the driving antenna 44 and each of the first parasitic antennas 46.

Each of the driving antenna 44, the first parasitic antennas 46, and the second parasitic antennas 48 respectively includes a soldering pad 44*a*, 46*a*, and 48*a*. The soldering pads 44*a*, 46*a* and 48*a* are soldered to the soldering pads 402 of the circuit board 40 via soldering tapes. Thus, the first parasitic antennas 46 and the second parasitic antennas 48 of the first supporting plates 50 and the second supporting plates 52 are positioned on the circuit board 40 with the driving antenna 44 as a center.

The driving antenna 44 of this embodiment includes a dual-band monopole antenna and can radiate wireless signals at frequencies of 2.4 GHz frequency band and of 5 GHz frequency band. As shown in FIG. 16, the driving antenna 44 includes a top section 442, a body section 444, and two wing sections 446 positioned at the two sides of the body section 444. Wherein, the top section 442 constitutes a top load of the driving antenna 44. The top section 442 is connected to the upper part of the body section 444, and a length of the top section 442 is smaller than that of the body section 444 while a width of the top section 442 is wider than that of the body section 444. Each of the wing section 446 includes a first interval 446*a*, a second interval 446*b* and a third interval 446*c* which are sequentially connected in a direction away from the body section 444, wherein the first interval 446*a* is connected with the body section 444; a length of the second interval 446*b* in the longitudinal direction of the second supporting plate 52 is greater than that of the first interval 446*a* and smaller than that of the third interval 446*c*. The two wing sections 446 constitute a bottom load of the driving antenna 44. In this embodiment, the length and the diameter of the top section 442 are respectively 5 mm 10 mm; the length and the diameter of the body section 444 are respectively 15.5 mm and 4 mm; and for each of the wing sections 446, the length and the diameter of the first intervals 446*a* thereof are respectively 1.5 mm and 2 mm, the length and the diameter of the second intervals 446*b* thereof are respectively 4.5 mm and 2.5 mm, and the length and the diameter of the third intervals 446*c* thereof are respectively 9.5 mm and 2.5 mm. In this embodiment, the top section 442 is corresponding to a 2.4 GHz frequency band, while the two wing sections 446 are corresponding to a 5 GHz frequency band.

For the first parasitic antennas 46 on the first and the second supporting plates 50, 52, the length and the diameter thereof are respectively 22.8 mm and 3.5 mm, while for the second parasitic antennas 48 on the first and second supporting plates 50, 52, the length and the diameter thereof are respectively 12.8 mm and 2 mm. The first parasitic antennas 46 is controlled by the control circuit to guide or reflect the 2.4 GHz wireless signals radiated by the driving antenna 44 to a specific direction, while the second parasitic antennas 48 are controlled by the control circuit to guide or reflect the 5 GHz wireless signals radiated by the driving antenna 44 to a specific direction.

The distance between the central axis of the driving antenna 44 and each central axis of the first parasitic antennas 46 on the first supporting plate 50 is between 35.19 mm and 45.19 mm, while in this embodiment, the distance is 40.19 mm. The distance between the central axis of the driving antenna 44 and each central axis of the second parasitic antennas 48 on the first supporting plate 50 is between 16.84 mm and 25.85 mm, while in this embodiment, the distance is 21.85 mm.

The distance between the central axis of the driving antenna 44 and each central axis of the first parasitic antennas 46 on the second supporting plate 52 can is between 26.34 mm and 36.34 mm, while in this embodiment, the distance is of 31.34 mm. The distance between the central axis of the driving antenna 44 and each central axis of the second parasitic antennas 48 on the second supporting plate 52 is between 5.6 mm and 15.6 mm, while in this embodiment, the distance is 10.6 mm.

The distance between each central axis of the first parasitic antennas 46 on the first supporting plate 50 and each central axis of the first parasitic antennas 46 on the second supporting plate 52 is between 45.87 mm and 55.87 mm, while in this embodiment, the distance is 50.87 mm. The distance between each central axis of the second parasitic antennas 48 on the first supporting plate 50 and each central axis of the second parasitic antennas 48 on the second supporting plate 52 is between 16.85 mm and 26.85 mm, while in this embodiment, the distance is 20.85 mm.

Figure 18:
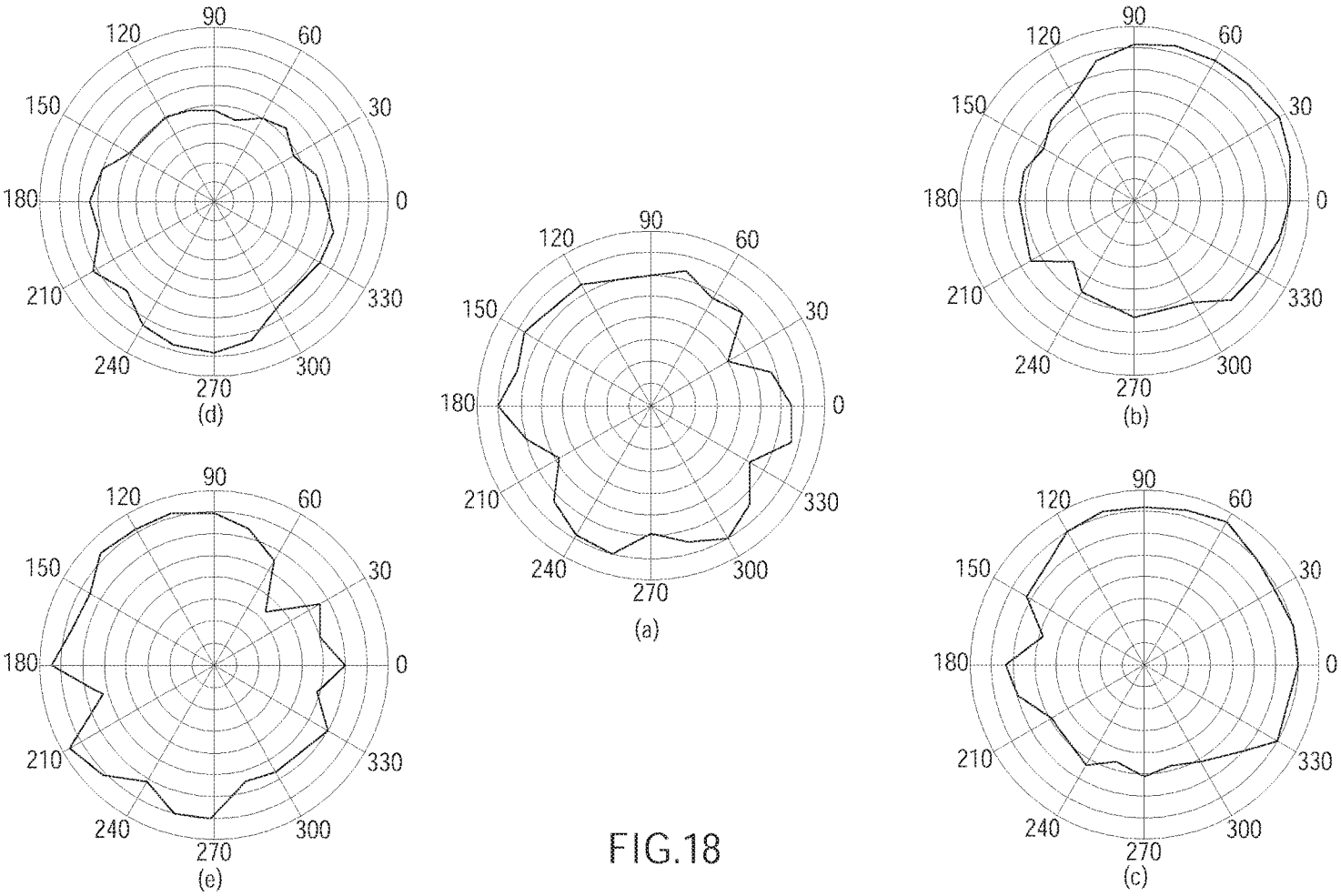
FIG. 18 is a radiation pattern of the antenna module operating at 2.4 GHz frequency band in accordance with the above embodiment of the present invention.

As shown in FIG. 15 and FIG. 18, the antenna set 42 shown in the bottom right corner of FIG. 15 and controlled to radiate 2.4 GHz wireless signals is illustrated as an example. Wherein, FIG. 18(*a*) is a radiation pattern of the antenna set 42 being controlled to radiate omnidirectional wireless signal beams; FIG. 18 (*b*) is a radiation pattern of the antenna set 42 which the wireless signal beams are controlled to be rightward radiated with respect to FIG. 15; FIG. 18 (*c*) is a radiation pattern of the antenna set 42 which the wireless signal beams are controlled to be upward radiated with respect to FIG. 15; FIG. 18(*d*) is a radiation pattern of the antenna set 42 which the wireless signal beams are controlled to be downward radiated with respect to FIG. 15; and FIG. 18(*e*) is a radiation pattern of the antenna set 42 which the wireless signal beams are controlled to be leftward radiated with respect to FIG. 15.

Figure 19:
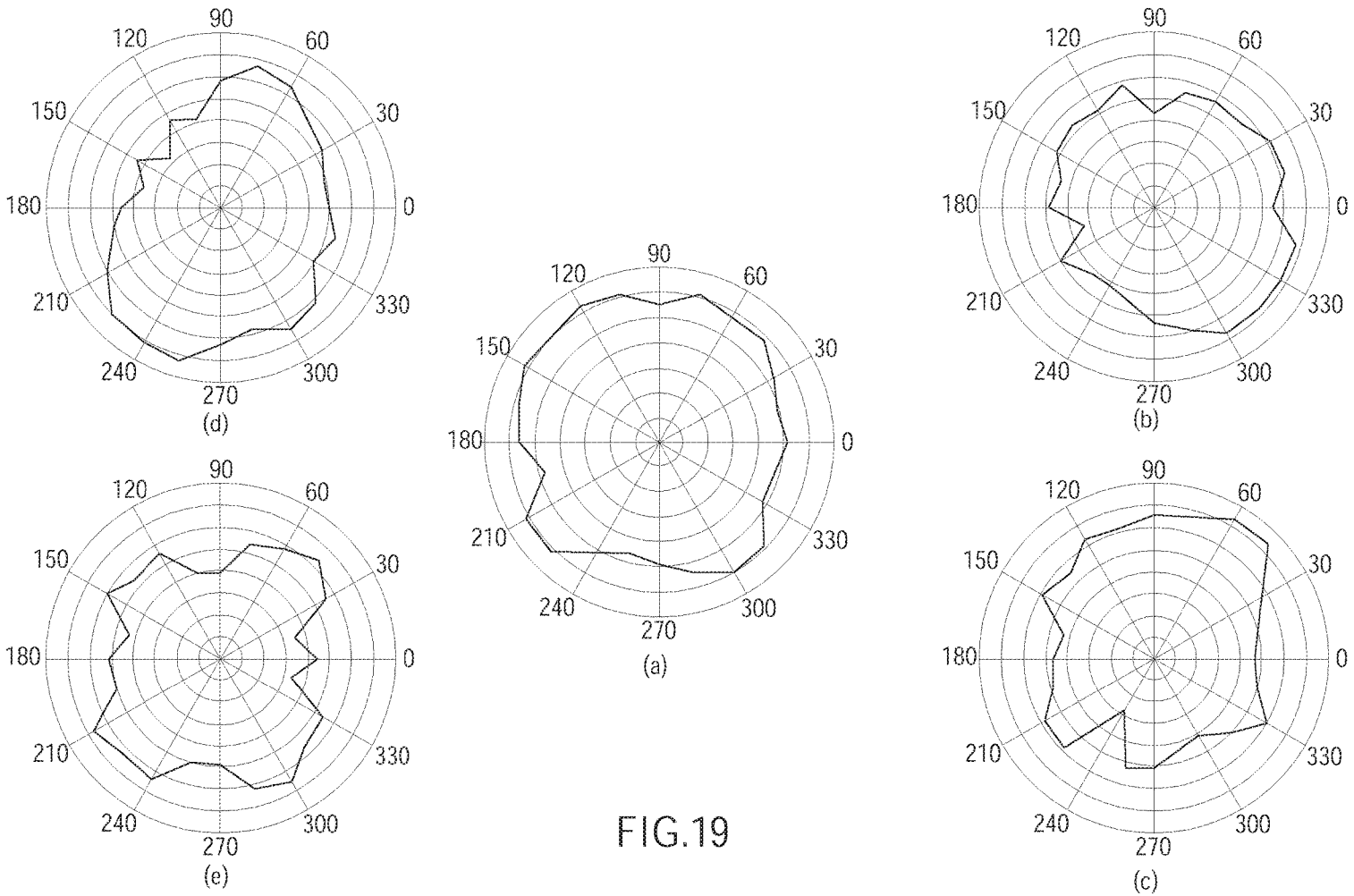
FIG. 19 is a radiation pattern of the antenna module operating at 5 GHz frequency band in accordance with the above embodiment of the present invention.

As shown in FIG. 15 and FIG. 19, the antenna set 42 shown in the bottom right corner of FIG. 15 and controlled to radiate 5 GHz wireless signal is illustrated as an example. Wherein, FIG. 19(*a*) is a radiation pattern of the antenna set 42 being controlled to radiate omnidirectional wireless signal beams; FIG. 19 (*b*) is a radiation pattern of the antenna set 42 which the wireless signal beams are controlled to be rightward radiated with respect to FIG. 15; FIG. 19 (*c*) is a radiation pattern of the antenna set 42 which the wireless signal beams are controlled to be upward radiated with respect to FIG. 15; FIG. 19(*d*) is a radiation pattern of the antenna set 42 which the wireless signal beams are controlled to be downward radiated with respect to FIG. 15; and FIG. 19(*e*) is a radiation pattern of the antenna set 42 which the wireless signal beams are controlled to be leftward radiated with respect to FIG. 15.

Thus, the antenna module 4 of this embodiment can constitute a 3×3 Multiple Input Multiple Output (MIMO) antenna module.

From the above, it can be understood that the antenna module 4 of this embodiment also can fulfill the demand of small size and the need of controlling wireless signal beams to be radiated intensively in a specific direction. In practical, the first and the second supporting plates 50, 52 can be only positioned with the first parasitic antennas 46 without the second parasitic antennas 48 or can be only positioned with the second parasitic antennas 48 without the first parasitic antennas 46, and then constitute a single band antenna 42.

From the above, the antenna module of the present invention includes a driving antenna and a plurality of parasitic antennas surrounding the driving antenna such that it can be controlled to radiate omnidirectional wireless signal beams or specific direction wireless signal beams, and the space occupied by the antenna module could be reduced. The control circuit also can be formed on the circuit board to save the space occupied by the wireless signal transceiver device.

It must be pointed out that the embodiments described above are only some embodiments of the present invention. All equivalent structures which employ the concepts disclosed in this specification and the appended claims should fall within the scope of the present invention.

What is claimed is:

1. An antenna module, comprising:

a circuit board; and at least one antenna set, which comprises a driving antenna and a plurality of parasitic antennas, wherein the driving antenna is positioned on the circuit board, and the parasitic antennas are positioned with the driving antenna as a center on the circuit board;

wherein the driving antenna is cylindrical, and includes a first section, a second section, and a third section which are connected in sequence, wherein, the third section is positioned between the second section and the circuit board; a diameter of the second section is greater than those of the first section and the third section; a length of the second section is longer than that of the third section; a length of the first section is shorter than that of the second section;

wherein each of the parasitic antennas is cylindrical, and comprises a first section and a second section which are connected with each other, wherein, for each of the parasitic antennas, a diameter of the first section thereof is greater than that of the second section thereof; a length of the first section thereof is longer than that of the second section thereof; each of the parasitic antennas is soldered to a soldering hole of the circuit board via the second sections.

2. The antenna module of claim 1, wherein the diameter and the length of the first section are respectively 2.6 mm and 2 mm; the diameter and the length of the second section are both 5 mm; the diameter and the length of the third section are respectively 2.6 mm and 4 mm.

3. The antenna module of claim 2, wherein the diameter and the length of the first section of each of the parasitic antenna are respectively 2.6 mm and 15 mm.

4. The antenna module of claim 1, wherein the plurality of parasitic antennas comprises four parasitic antennas; a distance between central axes of two neighboring parasitic antennas is between 25 mm and 35 mm, while a distance between a central axis of the driving antenna and the central axis of each of the parasitic antennas is between 16.2 mm and 26.2 mm.

5. An antenna module, comprising:

a circuit board; and at least one antenna set, which comprises a driving antenna and a plurality of parasitic antennas, wherein the driving antenna is positioned on the circuit board, and the parasitic antennas are positioned with the driving antenna as a center on the circuit board;

wherein the antenna module comprises a first supporting plate and a second supporting plate which are connected to the circuit board respectively; the first supporting plate and the second supporting plate are intersected with each other; the driving antenna is formed on the first supporting plate, and the plurality of parasitic antennas comprises four first parasitic antennas, wherein two of the first parasitic antennas are formed on the first supporting plate, and the other two of the first parasitic antennas are formed on the second supporting plate.

6. The antenna module of claim 5, wherein the first supporting plate comprises a slot formed above the driving antenna, and is joined with the second supporting plate via the slot.

7. The antenna module of claim 5, wherein the plurality of parasitic antennas comprises four second parasitic antennas; two of the second parasitic antennas are formed on the first supporting plate, while the other two of the second parasitic antennas are formed on the second supporting plate; each of the second parasitic antennas is positioned between the driving antenna and each of the first parasitic antennas.

8. The antenna module of claim 7, wherein the driving antenna includes a top section, a body section, and two wing sections positioned on two sides of the body section; the top section is connected to the body section; a length of the top section is less than that of the body section, and a width of the top section is greater than that of the body section; each of the wing sections comprises a first interval, a second interval, and a third interval which are sequentially connected in a direction away from the body section, wherein a length of the second interval is greater than that of the first interval, and is smaller than that of the third interval; the length and the width of the top section are respectively 5 mm and 10 mm, the length and the width of the body section are respectively 15.5 mm and 4 mm; the length of the first interval of each of the wing sections is 1.5 mm; the length of the second interval of each of the wing sections is 4.5 mm; the length of the third interval of each of the wing sections is 9.5 mm.

9. The antenna module of claim 8, wherein a distance between a central axis of the drive antenna and a central axis of each of the first parasitic antennas formed on the first supporting plate is between 35.19 mm and 45.19 mm, while a distance between the central axis of the driving antenna and the central axis of each of the second parasitic antennas formed on the first supporting plate is between 16.85 mm and 25.85 mm.

10. The antenna module of claim 8, wherein a distance between the central axis of the driving antenna and a central axis of each of the first parasitic antennas formed on the second supporting plate is between 26.34 mm and 36.34 mm, while a distance between the central axis of the driving antenna and the central axis of each of the second parasitic antennas formed on the second supporting plate is between 5.6 mm and 15.6 mm.

11. The antenna module of claim 8, wherein a distance between a central axis of each of the first parasitic antennas formed on the first supporting plate and a central axis of each of the first parasitic antennas formed on the second supporting plate is between 45.87 mm and 55.87 mm, while a distance between a central axis of each of the second parasitic antennas formed on the first supporting plate and a central axis of each of the second parasitic antennas formed on the second supporting plate is between 16.85 mm and 26.85 mm.

* * * * *